US007188738B2

(12) United States Patent
Stafford et al.

(10) Patent No.: US 7,188,738 B2
(45) **Date of Patent: *Mar. 13, 2007**

(54) MEDICATION MINDER

(75) Inventors: Carol J. Stafford, Millington, NJ (US); Beth D. Ziff, Leonia, NJ (US)

(73) Assignee: Customer Advantage LLC, New Providence, NJ (US)

( * ) Notice: Subject to any disclaimer, the term of this patent is extended or adjusted under 35 U.S.C. 154(b) by 284 days.

This patent is subject to a terminal disclaimer.

(21) Appl. No.: 10/935,168

(22) Filed: Sep. 7, 2004

(65) Prior Publication Data

US 2005/0205439 A1 Sep. 22, 2005

Related U.S. Application Data

(60) Provisional application No. 60/554,268, filed on Mar. 18, 2004.

(51) Int. Cl.
*A47G 29/00* (2006.01)

(52) U.S. Cl. ..... 211/72; 211/10; 211/87.01

(58) Field of Classification Search ..... 211/72, 211/11, 87.01, 10, 55, DIG. 1; 206/371; 40/358, 657

See application file for complete search history.

(56) References Cited

U.S. PATENT DOCUMENTS

| | | | | |
|---|---|---|---|---|
| 1,320,270 | A * | 10/1919 | Phelps | 16/249 |
| 1,726,664 | A * | 9/1929 | Harshman | 312/129 |
| 1,770,519 | A * | 7/1930 | Harshman | 312/129 |
| 3,684,102 | A * | 8/1972 | Colter | 211/88.01 |
| 4,463,848 | A * | 8/1984 | Parker | 206/214 |
| 4,614,360 | A | 9/1986 | Sheehan et al. | 281/45 |
| 4,768,298 | A * | 9/1988 | Polhemus et al. | 40/358 |
| 4,815,767 | A | 3/1989 | Lambert | 283/67 |
| 5,097,961 | A * | 3/1992 | Patino et al. | 211/10 |
| 5,102,169 | A | 4/1992 | Mayfield | 283/115 |
| 5,261,702 | A | 11/1993 | Mayfield | 283/115 |
| 5,339,546 | A | 8/1994 | Rahwan | 40/107 |
| 5,431,450 | A | 7/1995 | Coleman | 283/62 |
| 5,526,943 | A * | 6/1996 | Thompson | 211/87.01 |
| 5,755,338 | A * | 5/1998 | vom Braucke et al. | 211/13.1 |
| 5,758,096 | A | 5/1998 | Barsky et al. | 395/203 |
| 5,803,275 | A * | 9/1998 | Schweitzer | 211/88.01 |
| 5,884,784 | A * | 3/1999 | Betts, Sr. | 211/88.01 |
| 5,995,938 | A | 11/1999 | Whaley | 705/3 |
| 6,092,672 | A * | 7/2000 | Harris et al. | 211/11 |
| 6,152,311 | A * | 11/2000 | German | 211/86.01 |
| 6,364,126 | B1 * | 4/2002 | Enriquez | 211/13.1 |
| 6,442,878 | B1 * | 9/2002 | Letterio | 40/124.4 |
| 6,968,959 | B1 * | 11/2005 | Garvin | 211/50 |

OTHER PUBLICATIONS

Web Catalog, http://www.docyourmeds.com/pp. 1 and 2.

* cited by examiner

*Primary Examiner*—Jennifer E. Novosad
(74) *Attorney, Agent, or Firm*—Kenneth Watov; Watov & Kipnes, P.C.

(57) ABSTRACT

Apparatus for assisting individual or multiple patients to comply with a medication dosage schedule, and/or other medical regimen, and maintain a log of associated activities, includes a wall or table mountable base member upon which is mounted a log pad, a question pad, a card holder, a document holder, and a medication bin for retaining medication containers.

27 Claims, 8 Drawing Sheets

MEDICATION MINDER

This Application is related to and takes priority from Provisional Application Ser. No. 60/554,268, filed on Mar. 18, 2004, for "Medication Minder"; and is also related to Design Application Ser. No. 29/212,735, filed herewith and entitled "Medication Minder Device." The subject related Applications have the same inventorship, and a common Assignee.

FIELD OF THE INVENTION

The field of the present invention relates generally to devices for retaining medication in an organized manner for facilitating the dispensation thereof, and more particularly relates to devices for ensuring that a patient or user complies with a prescribed schedule for taking medication, or for some other medical regimen.

BACKGROUND OF THE INVENTION

It has long been recognized that a major problem in the dispensation of medication, when left to a patient, is often dispensed in error, and at times not at all. Many different devices have been invented over the years to assist the patient in taking medication in a prescribed scheduled manner. Such devices include pillboxes having a plurality of compartments, each of which may be marked with a different day of the week, or perhaps the dates may be shown on the cover for each of the compartments. In using such a device, the patient would then note the day or date, go to the proper compartment, and remove the pills for consumption. Other similar devices have been developed over the years, some of which are circular, whereby a patient rotates a portion of the device each day, for receiving a pill or pills that must be taken on a daily basis. Similar problems exist for dispensing liquid, and other forms of medication.

There is a need in the art for a simplified device to provide a method for increasing patient compliance and the tracking of physician prescribed, or self prescribed medication, or other medical regimens on a scheduled basis, be it a daily basis and/or weekly basis, for example. Such a device should permit a patient or health care provider or user to log and track the taking of various medication by a given patient, and also provide a patient capable of doing so to similarly log and track their prescribed taking of medication, or following a medical regimen. Known devices include computerized logging and tracking, and the use of electronic and electromechanical devices, for permitting a patient or medical provider or user to program the devices to emit an audible signal and/or energize a light at times that medication must be taken. Such devices may even include a plurality of electromechanically operated drawers that slide open at the time medication must be taken, and otherwise remain locked. Such devices are relatively complicated to program, and by their very nature are expensive.

There is also a need in the art for permitting patients or medical providers or users to easily list and record questions that they may have, information requirements, reactions to various medications, and so forth to discuss with the attending physician and/or other medical professionals assisting in the care of a patient or user. Another need in the art is to include with a device or apparatus assisting in the logging and tracking of the taking of medication, means for retaining and making readily available appointment cards, physician and hospital business cards, ambulance service cards, prescriptions, and other important information or material associated with a given patient. Additionally, it would beneficial for a user or patient to be provided a medication holding mechanism in association with the logging and tracking device or apparatus.

The present inventors recognize that there is a need in the art for providing a low cost multifunctional apparatus for not only helping patients or users to receive medication or follow a medical regimen in a proper prescribed manner, but also for providing necessary record keeping related thereto.

SUMMARY OF THE INVENTION

The present invention provides a means for ensuring that a patient or user complies with a prescribed medication schedule, and maintains required records, with such means including a panel that can be hung on the wall, or held upright on a desk, or secured to a refrigerator, for example, with the panel including in its lowermost surface a medication shelf or bin for safely holding a plurality of different sized medication containers; the upper surface above the shelf having attached thereto a medication log facilitating the logging and tracking of medication taken on a time prescribed basis for individual or multiple users, a pad permitting users to list questions for the doctor associated with one or more patients using the system, one or more holders for retaining appointment cards, physicians and therapist business cards, prescriptions, instructions, and so forth, preferably with at least one holder being transparent to permit a user to see a next appointment card at a glance.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

Figure 1:
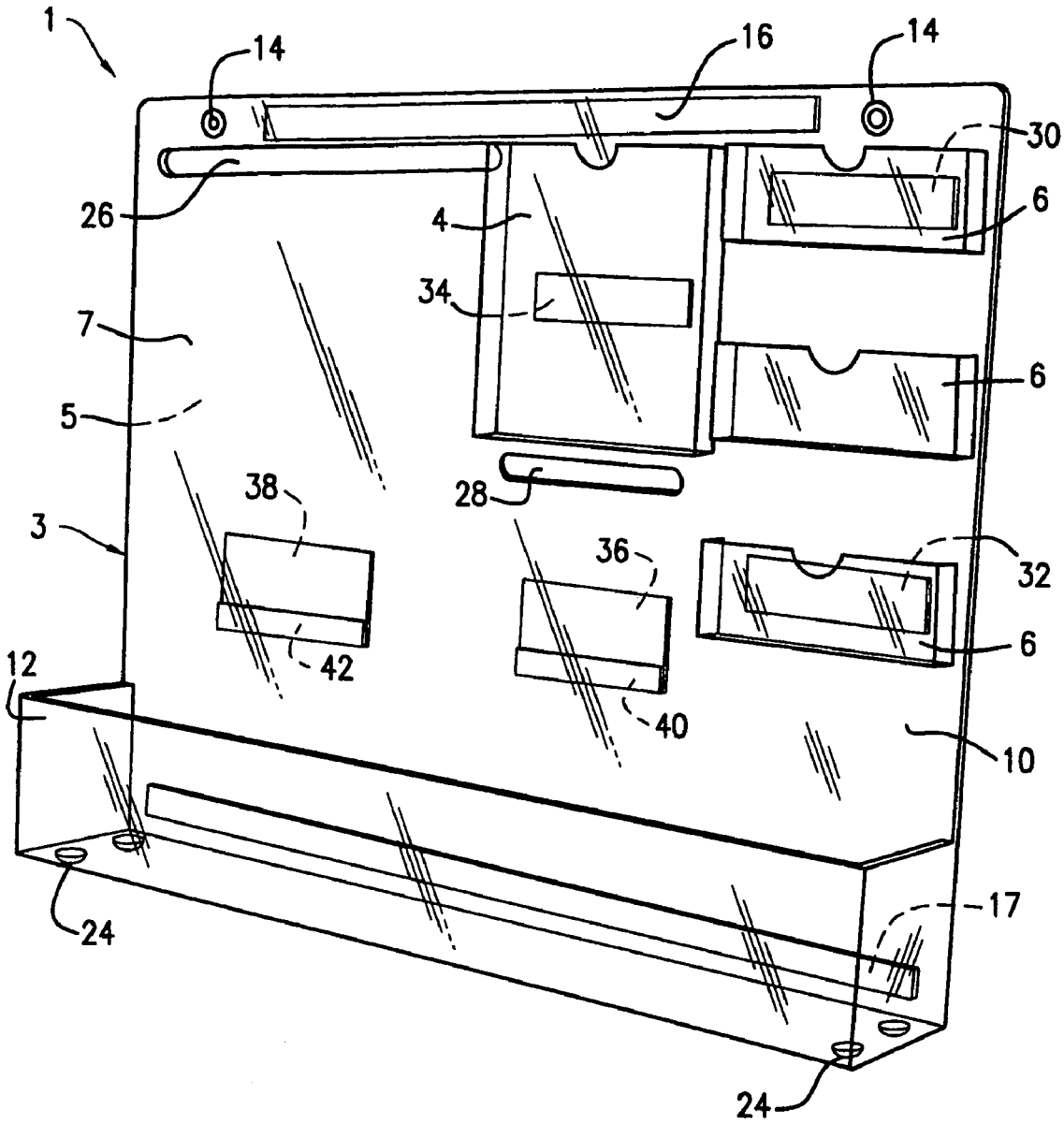
FIG. 1 is a front perspective view of a Medication Minder showing various embodiments of the invention.
Figure 2:
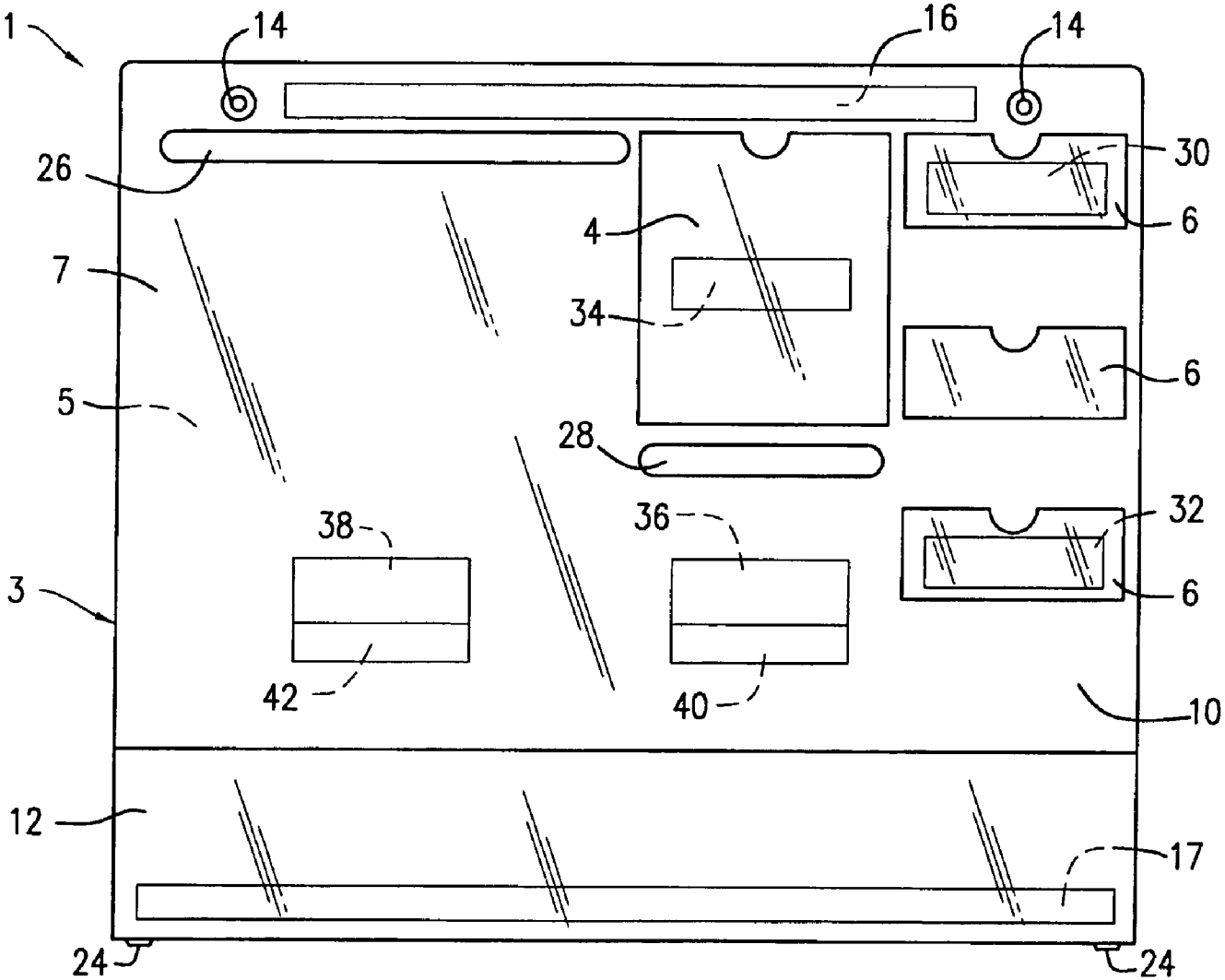
FIG. 2 is a front elevational view thereof.

The present invention, identified as a "Medication Minder" by the inventors, provides a unified multifunctional, low cost, mechanical device or apparatus for permitting a patient and/or caretaker for the patient or user to both schedule, log, and track the taking of medication or other medical regimen on a prescribed basis by the patient, and also to have ready access to important information, and material associated with the patient's needs. In one embodiment of the present invention, as shown in FIGS. 1–10, the "Medication Minder" 1 includes a flat board-like base member 3 having a back face 5 and a front face 7. A preferred embodiment of the invention, as shown in the figures, includes a medication log pad 2, a document pouch or bin 4, a plurality of cardholder pouches or bins 6, a pad 8 for questions and comments, and a medication holder or shelf 12 are securely attached to and arranged upon the face 7 of the base member 3, as shown. Also, feet 24 of elastomer material, such as a plastic or rubber are attached to the bottom 25 for standing the present device 1 on a table or other flat surface. Note that the present invention is not meant to be limited to the arrangement shown, whereby the aforesaid items or components can be arrangement upon the base member 3 in any other desired configuration. A pair of holes 14 are located proximate the top edge of the base member 3, and spaced apart, whereby each of the holes 14 is located near the right and left side edges of the base member 3, for permitting the "Medication Minder" 1 to be hung on a wall. Also, in a preferred embodiment, five magnets 16, 17, 30, 32, and 34 are permanently secured via adhesive or other appropriate means to the back face 5, respectively, in locations as shown. The magnets 16, 17, 30, 32, and 34 permit the "Medication Minder" 1 to be easily attached to the surface of a refrigerator, or other flat metal surface. The functional aspects of the various aforesaid items mounted on the front face 7 of the base member 3 are described in greater detail below, with particular reference to FIG. 10.

Medication Minder 1:

The Medication Minder 1 is a patient or user compliance tool or kit that can be used for individual or multiple patients or users in the same household, rest home, hospital, or medical care center. The multifunctional Minder 1 allows the user(s) and/or patients to keep medicines, prescriptions, appointment cards, exercise routines, and other information in an organized storage unit. When users take their medication they can immediately record the day and time they took it as well as any related information and/or questions. Users and/or patients are thus able to maintain a documented log of medications prescribed, and when the medications were taken. Caregivers are able to use the Medication Minder 1 to ensure patient compliance. An example is an assisted living facility where a caregiver is provided the ability to review the medicine log 2 of a patient, maintain a record of compliance and other patient recorded information, all in one organized tool. The Medication Minder 1, as indicated, can be used in a variety of locations. It can be secured to any magnetic surface, or hung on a wall or in a cabinet, or can stand alone on any flat surface, as described in greater detail below. Also, the Medication Minder 1 can be used in association with medical or health regimens other than the taking of medication, such as exercise routines, for example.

Figure 10:
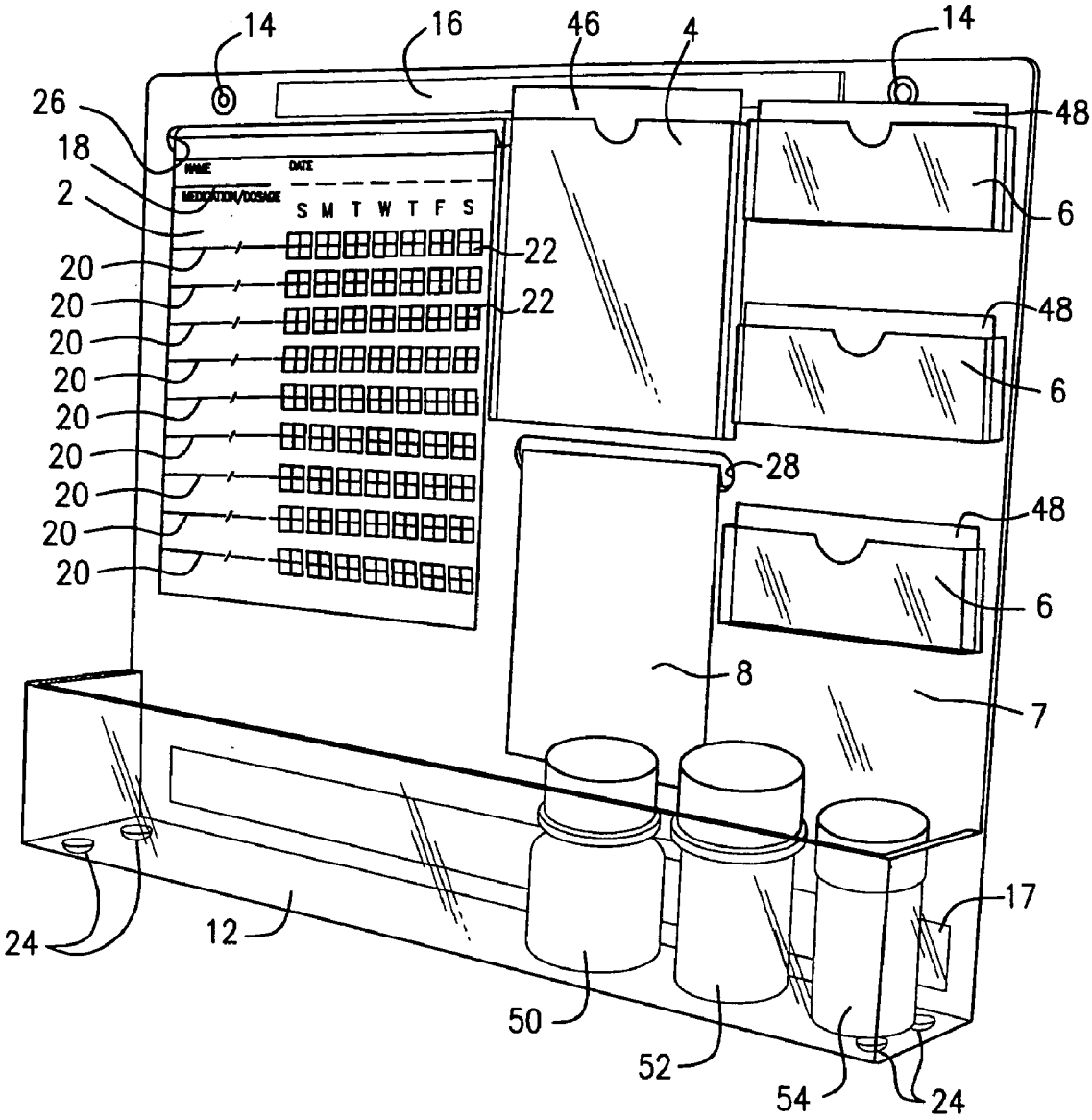
FIG. 10 is front perspective view of an embodiment of the invention with pads and medicine containers installed.

Log Pad 2:

In a preferred embodiment a medicine log pad 2 is located on the upper left portion of the base member 3. The medicine log pad 2 increases patient compliance through the logging and tracking of medication intake on a daily and weekly basis. The pad 2 includes tear-off sheets, each sheet is identically imprinted, and has designated spaces to list each medication and its prescribed dosage. The user lists the time each medication is taken on a daily or day basis. The pad 2 allows the user to create new logs each week and also allows for multiple users. The information logged can be saved and filed for reference and record keeping. Medicine log pad 2 refills can be sold separately. In one embodiment, for example, as shown in FIG. 10, the pad 2 indicia includes a top left line 18 for inserting a patient's name. Below the name line is column of a plurality of rows of spaced apart lines 20 for inserting on each the name/dosage of a given medication. To the right of each name/dosage line 20 in the same row are seven blocks 22, each being in a column for Sunday through Saturday, respectively. In this example, each block is divided into four sections for permitting up to four different times to be inserted for recording medication ingestion times on a given day for a given medication by the patient or user. The medicine log pads 2, in one embodiment, are secured to base 3 via Velcro® attachments (not shown). The medicine log pad 2 can be otherwise configured relative to FIG. 10. For example, indicia can be provided on log pad 2 for tracking blood sugar readings, weight, food intake, blood pressure, and any other health related regimens.

Figure 3:
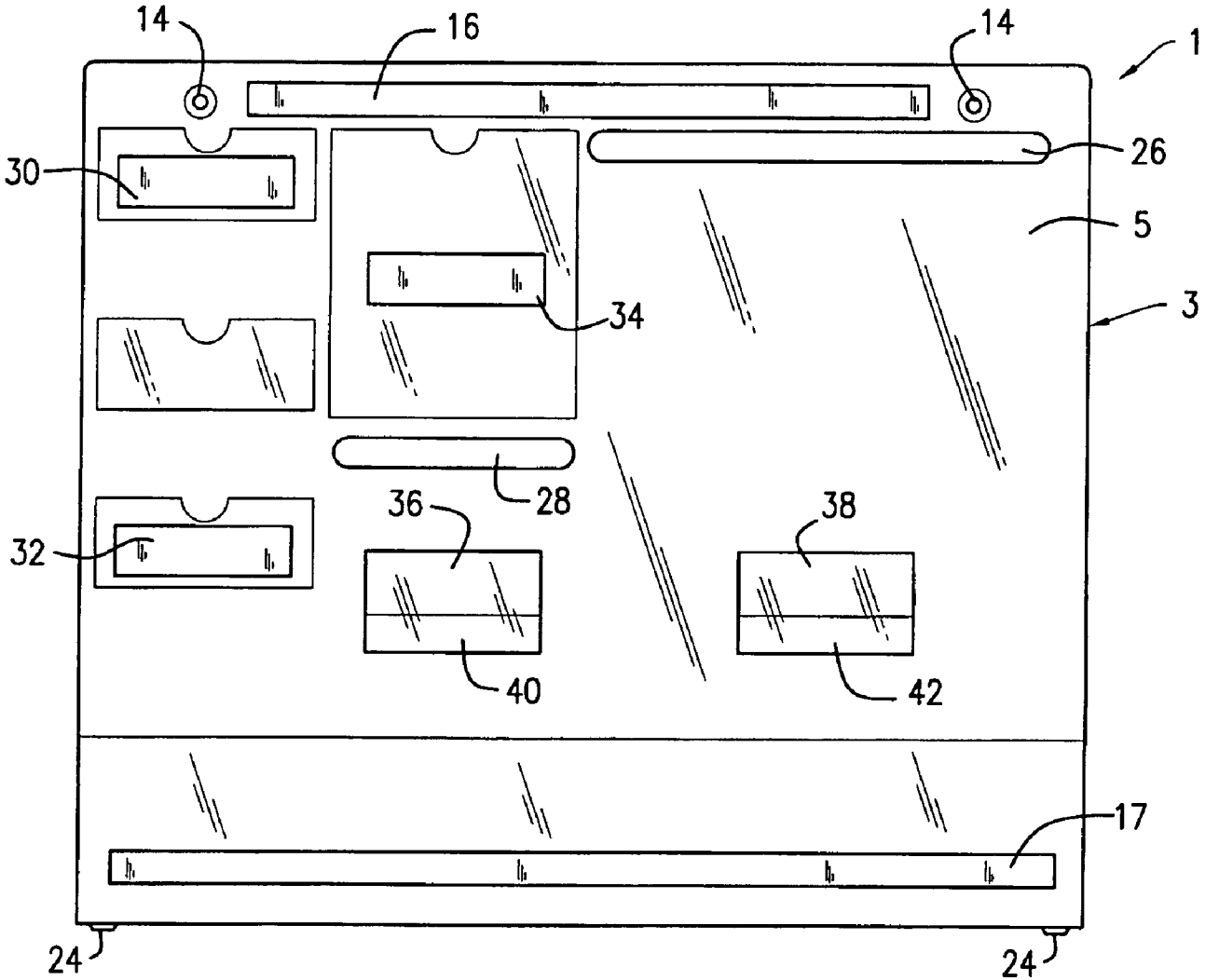
FIG. 3 is a back elevational view thereof.
Figure 4:
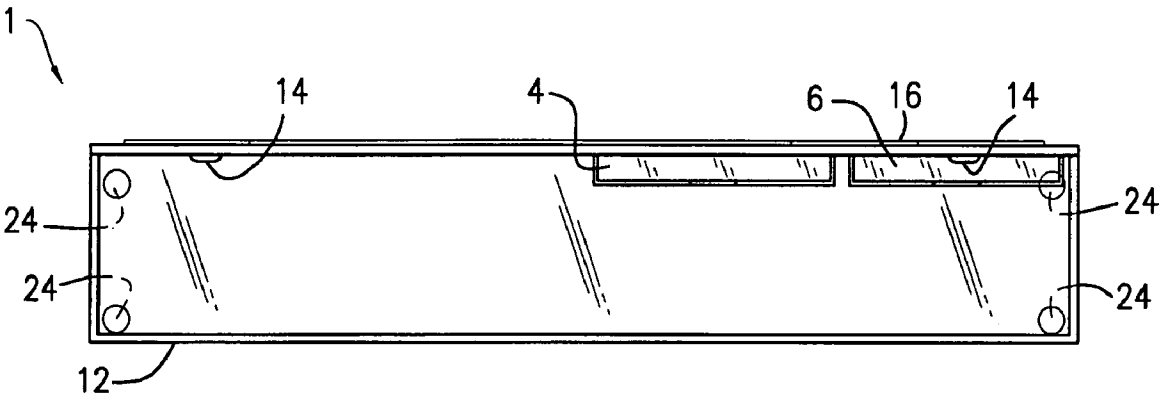
FIG. 4 is a top plan view thereof.
Figure 5:
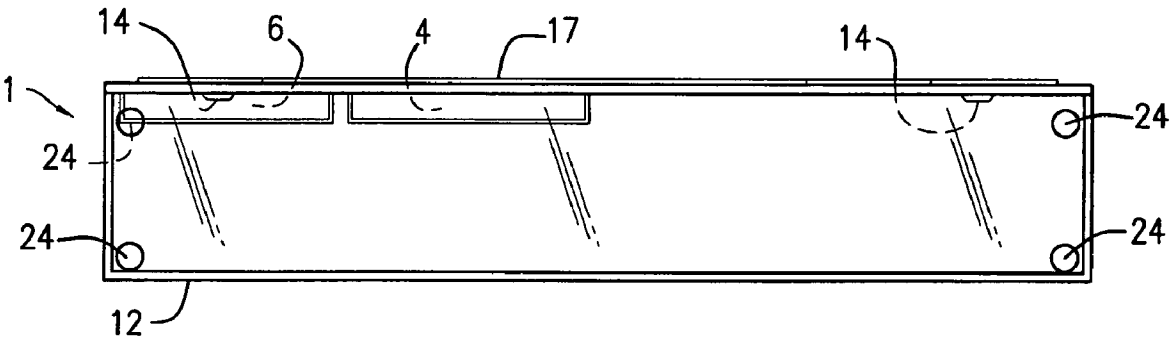
FIG. 5 is a bottom plan view thereof.
Figure 7:
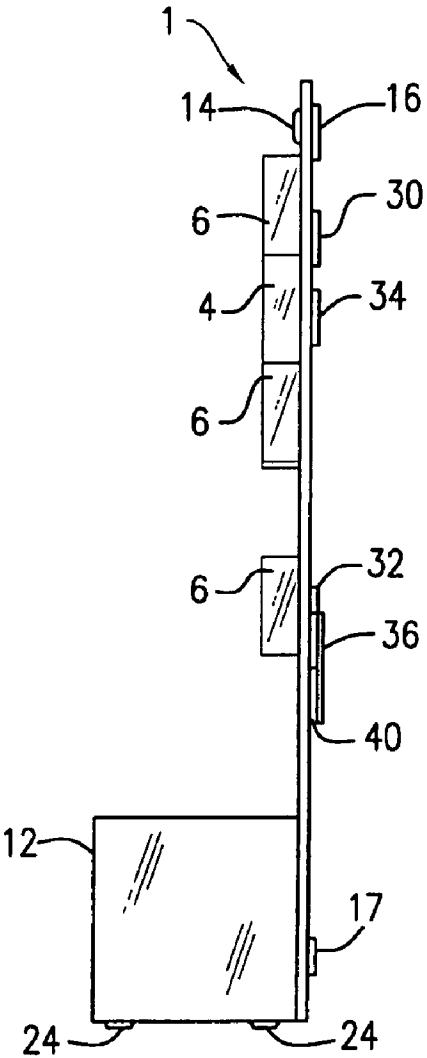
FIG. 7 is a right side elevational view thereof.
Figure 6:
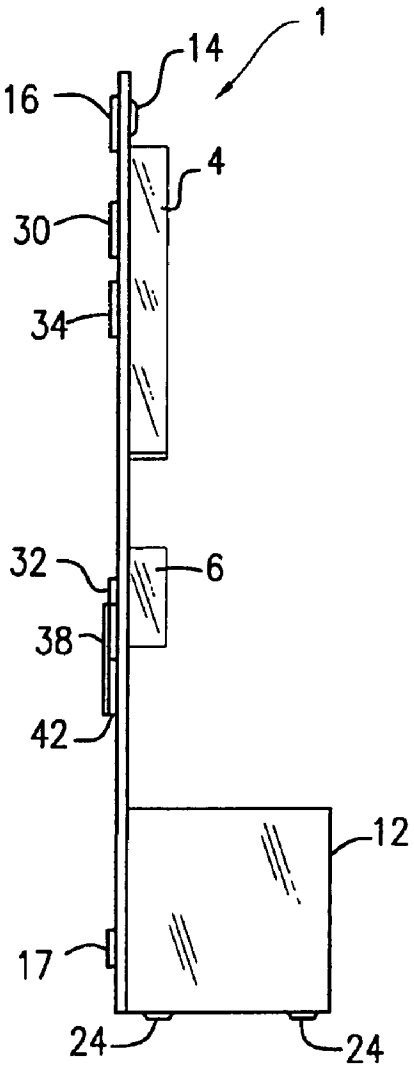
FIG. 6 is a left side elevational view thereof.
Figure 8:
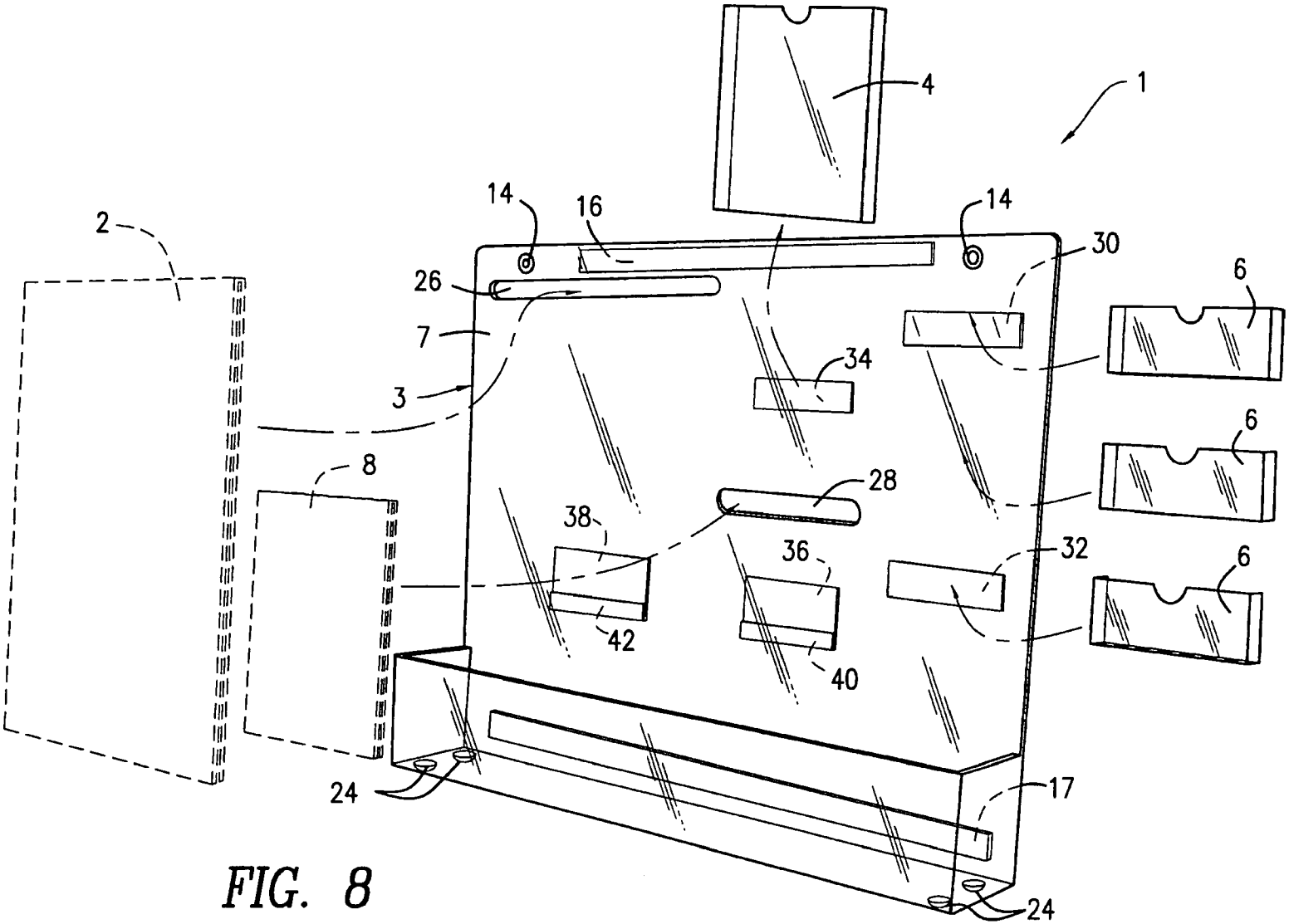
FIG. 8 is an exploded assembly view looking toward the front thereof.
Figure 9:
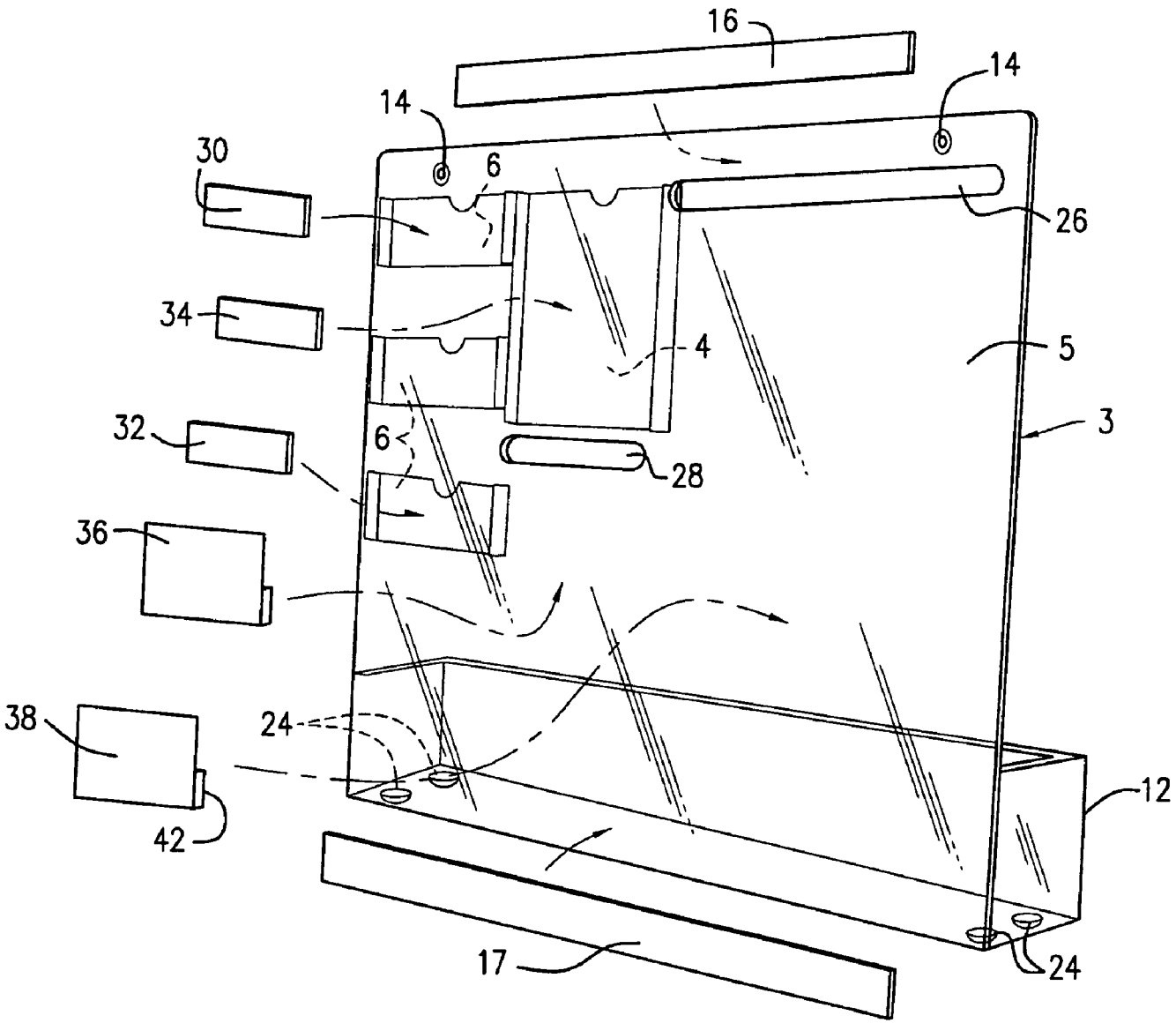
FIG. 9 is an exploded assembly view looking from the back thereof.

Questions for the Doctor Pad 8:

A pad 8 imprinted at the top with "Questions for the Doctor" is located to the lower right of the medicine log pad 2. The pad 8 is another patient compliance tool for patients or users to list questions, reactions to drugs, and so forth, for their doctor and other medical professionals. Patients or users can also use the pad 8 to list other information and experiences to discuss with their medical professional. Question pad 8 refills are replaceable, and in one embodiment attached to the base 3 via Velcro® attachments (not shown). In a preferred embodiment, as shown in FIGS. 1 and 3, open slots 26 and 28 are formed through base member 3 for permitting the backing member (typically a sheet of cardboard) of pads 2 and 8, respectively, to be pushed through the associated slot 26, 28, and secured in a space between retaining tabs 38, 36, respectively, and the back surface of base member 3, rather than use Velcro®. Note that pad 8 is not meant to be limited to inserting questions for a doctor, but can be used for any type of information.

Document Bin 4:

An open top pouch-like document bin 4 is located to the upper right of the medication minder pad 2. The document bin 4 allows users to keep prescriptions, important information, instructions and other documents 46 organized in one central location.

Card Holders 6:

Open top pouch-like card holders 6 are located to the right of document bin 4 and question pad 8, as shown. The card holders 6 are a place for patients or other users to put appointment cards and medical professionals' business cards 48, for example. In a preferred embodiment, each holder 6 is made from transparent plastic material, in this example. Each transparent holder 6 is an "at a glance" reminder for patients or other users regarding appointments and other essential medical contact information. Note that the invention is not meant to be limited to transparent card holders 6, which can be made from either transparent or opaque material.

Medication Shelf 12:

An open top medication shelf or storage bin 12 is secure to the bottommost portion of base member 3 in this example. The medication shelf 12 increases patient or user compliance by allowing patients or users to keep their medications in one organized easily accessible location. The shelf 12, in providing a completely open top but otherwise enclosed bin, is capable of holding a plurality of multiple sized medication containers such as 50, 52, and 54, for example. Flat feet 24 are affixed to and spaced apart on the bottom 25 of shelf 12, for permitting the Medication Minder 1 to be placed on a table top or other flat horizontal surface in one embodiment of the invention. The feet 24 can be provided by an elastomer material, such as a plastic or rubber, for example, as previously mentioned. Note for purposes of this invention medication is meant to include physician prescribed medication, self-prescribed medication such as over the counter medication and vitamins, and so forth.

Logo Imprint Area 10:

A logo imprint area 10 is provided to hold a company logo, reorder and contact information, and so forth. Additionally, sponsoring company information can be printed in this area 10.

Additional preferred embodiments for the present Medication Minder 1 include making the wall mounting holes 14 grommet holes, whereby metal or elastomer material grommets are retained in the holes for preventing tearing of the material surrounding the holes of the base member 3. Also, as a preferred alternative to using velcro® attachments for the Medication Minder pad 2, and question pad 8, open slots 26 and 28, respectively, are provided at appropriate positions through the front 7 of the base member 3 for receiving the backing member of the pads 2, 8, respectively, as previously mentioned. In this manner, the pads 2 and 8 can easily be replaced. Note also that the magnets 16, 17, 30, 32, and 34 described above, must be made strong enough to support the Medication Minder 1 at times that the shelf 12 is filled with medication containers, in order to avoid any slippage or movement of the Medication Minder 1 when mounted on a magnetizable panel, such as found on a refrigerator or metal cabinet, for example.

In an engineering prototype of the Medication Minder 1, the medication log pad 2 has dimensions of 7.5 inches wide and ten inches high, and has twenty-five pages (the 20th page is a colored re-order label). The question pad 8 has dimensions of four inches wide, and five inches high, and has fifty pages. The document bin or pouch 4 is 4.75 inches high, 4.325 inches wide, and 0.375 inches deep. The card holders 6 are four inches wide, 1.5 inches high, and 0.375 inch in depth. The vertical spacing between the card holders 6 is 1.5 inches. The dimensions of the base member 3 are 17.5 inches wide, 14.0 inches high, and 2.75 inches deep. The medication shelf 12 is 2.875 inches high, 17.5 inches wide, and 2.75 inches deep. Note that the various embodiments of the invention are not limited to the aforesaid example of dimensions used for various of the Medication Minder 1 components, and can be made any practical size, as desired. Also, the location of the various components associated with the present Medication Minder 1 can be changed from that shown for the preferred embodiments of the invention.

The Medication Minder 1, in a preferred embodiment, consists of transparent acrylic material for base member 3, medication shelf 12, retaining tabs 38, and 36, document bin 4, and card holders 6. In one embodiment retaining tabs 36 and 38 include standoff strips 40, 42, respectively of acrylic material sonically welded together. All of the aforesaid components are rigidly secured to base member 3 via sonic welding, in this example. Any other known methods, such as use of appropriate acrylic cements, adhesives, and so forth, can be used to secure the components to the base member 3. Note that the present invention is not limited to use of transparent acrylic material, whereby any suitable material such as plastic, metal, wood, glass, and so forth, can be used, regardless of transparency. Plastic materials such as acrylic, lucite, polycarbonate, and so forth can be used.

Although various embodiments of the invention have been shown and described, they are not meant to be limiting. Those of skill in the art may recognize certain modifications to these embodiments, which modifications are meant to be covered by the spirit and scope of the appended claim or claims.

What we claim is:

1. Record keeping and logging apparatus for assisting a patient and/or medical provider and/or user in the control of compliance with specified medical regimens for one or a plurality of patients, or users, said apparatus comprising:

a base member configured from sheet material;

means for selectively either mounting said base member on a wall or an appliance, said base member having a front and a back;

a log pad mounted on the front of said base member for logging and tracking medication intake and/or health related regimens by at least one patient or user;

a questions pad mounted on the front of said base member for listing questions, information, and medical related experiences for professional consideration and/or answers;

at least one card holder mounted on the front of said base for retaining medically related business cards, appointment cards, and other medical contact information;

a document holder mounted on the front of said base for retaining prescriptions, medication instructions, therapy instructions, and other medically related documents; and a medication bin mounted in a rigidly fixed position on the front of a lowermost portion of said base, said bin including a fully enclosed area with an open top portion for receiving medication containers for secure retention within said bin, a bottom portion of said bin being configured for standing said apparatus upright on a flat horizontal surface.

2. The apparatus of claim 1, further including a plurality of card holders spaced apart from one another and said document holder.

3. The apparatus of claim 2, wherein at least one of said plurality of card holders consists of transparent material.

4. The apparatus of claim 2, wherein said base member, plurality of card holders, document holder, and medication bin each consist of plastic material.

5. The apparatus of claim 4, wherein said plastic material consists of transparent acrylic material.

6. The apparatus of claim 4, wherein said plurality of card holders, document holder, and medication bin are each sonically welded to said base member.

7. The apparatus of claim 1, wherein said card holder consists of transparent material.

8. The apparatus of claim 1, wherein said base member, card holder, document holder, and medication bin each consist of plastic material.

9. The apparatus of claim 8, wherein said plastic material consists of transparent acrylic material.

10. The apparatus of claim 8, wherein said card holder, document holder, and medication bin are each sonically welded to said base member.

11. The apparatus of claim 1, further including:

a first open slot formed in said base member for receiving a backing sheet of said log pad, for removable mounting and replacement thereof on said base member.

12. The apparatus of claim 11, further including:

a second open slot formed in said base member for receiving a backing sheet of said questions pad, for removable mounting and replacement thereof on said base member.

13. The apparatus of claim 12, further including:

a tab secured to the back of said base member below said second open slot for retaining an end portion of the backing sheet of said questions pad.

14. The apparatus of claim 12, further including:

first and second tabs secured to the back of said base member below said first and second open slots, respectively, for retaining end portions of the backing sheets of said log pad, and said questions pad, respectively.

15. The apparatus of claim 11, further including:

a tab secured to the back of said base member below said first open slot for retaining an end portion of the backing sheet of said log pad.

16. The apparatus of claim 1, wherein said at least one card holder, document holder, and medication bin each have an open top, right and left opposing sides, and a bottom.

17. The apparatus of claim 1, wherein said means for selectively mounting said base member on either a wall or an appliance includes:

a pair of spaced apart holes through a top portion of said base member for respectively receiving wall mounting hooks.

18. The apparatus of claim 1, wherein said means for selectively mounting said base member on either a wall or an appliance includes:

a plurality of spaced apart magnets each secured to the back of said base member.

19. The apparatus of claim 18, wherein said plurality of spaced apart magnets includes:

a first magnetic strip secured proximate and parallel to a top edge of said base member; and a second magnetic strip secured proximate and parallel to a bottom edge of said base member.

20. The apparatus of claim 19, further including:

third through fifth spaced apart magnetic strips secured to said base member between said first and second magnetic strips.

21. The apparatus of claim 1, further including:

a plurality of feet members secured to a bottom surface of a bottom of said medication bin, for permitting said apparatus to stand upright on a horizontal surface.

22. The apparatus of claim 1, further including:

said log pad being mounted on a left-hand portion of said base member proximate both said medication bin and a top edge of said base member;

said document holder being mounted directly to the right of said log pad on an upper central portion of said base member;

said questions pad being mounted on said base member between a bottom edge of said document holder and said medication bin;

first and second said card holders being mounted on said base member in spaced vertically apart relation from one another, and to the right of said document holder; and a third said card holder being mounted on said base member to the right of said questions pad.

23. The apparatus of claim 22, wherein said log pad includes a plurality of identically printed tear-off sheets each having indicia including:

an uppermost row including a plurality of spaced apart lines for successively from left to right writing in a patient's name, and the dates for one or more days of a week for scheduling mediation dosage;

a plurality of vertically successive rows of spaced apart lines and blocks, left-hand first and second lines being designated for inserting a medication name or identity and required dosage, said first and second lines being followed by third through ninth blocks configured for permitting for each day of a given week the AM and PM dosage of medication to be indicated and confirmed when taken; and said plurality of spaced apart lines and blocks being arranged in nine juxtaposed columns, including seven successive columns of said blocks, with each column being labeled for indicating successive days of a given week, respectively.

24. The apparatus of claim 1, wherein said log pad includes a plurality of identically printed tear-off sheets each having indicia including:

an uppermost row including a plurality of spaced apart lines for successively from left to right writing in a patient's name, and the dates for one or more days of a week for scheduling mediation dosage;

a plurality of vertically successive rows of spaced apart lines and blocks, left-hand first and second lines being designated for inserting a medication name or identity and required dosage, said first and second lines being followed by third through ninth blocks configured for permitting for each day of a given week the AM and PM dosage of medication to be indicated and confirmed when taken; and said plurality of spaced apart lines and blocks being arranged in nine juxtaposed columns, including seven successive columns of said blocks, with each column being labeled for indicating successive days of a given week, respectively.

25. Record keeping and logging apparatus for assisting a patient and/or medical provider and/or user in the control of compliance with specified medical regimens for one or a plurality of patients, or users, said apparatus comprising:

a base member configured from sheet material;

means for selectively either mounting said base member on a wall or an appliance, said base member having a front and a back;

a log pad mounted on the front of said base member for logging and tracking medication intake and/or health related regimens by at least one patient or user;

a questions pad mounted on the front of said base member for listing questions, information, and medical related experiences for professional consideration and/or answers;

at least one card holder mounted on the front of said base for retaining medically related business cards, appointment cards, and other medical contact information;

a document holder mounted on the front of said base for retaining prescriptions, medication instructions, therapy instructions, and other medically related documents;

a medication bin mounted on the front of a lowermost portion of said base, said bin being configured for retaining a plurality of medication containers, and for standing said apparatus on a flat horizontal surface;

an open slot formed in said base member for receiving a backing sheet of said log pad, for removable mounting and replacement thereof on said base member; and a tab secured to the back of said base member below said open slot for retaining an end portion of the backing sheet of said log pad.

26. Record keeping and logging apparatus for assisting a patient and/or medical provider and/or user in the control of compliance with specified medical regimens for one or a plurality of patients, or users, said apparatus comprising:

a base member configured from sheet material;

means for selectively either mounting said base member on a wall or an appliance, said base member having a front and a back;

a log pad mounted on the front of said base member for logging and tracking medication intake and/or health related regimens by at least one patient or user;

a questions pad mounted on the front of said base member for listing questions, information, and medical related experiences for professional consideration and/or answers;

at least one card holder mounted on the front of said base for retaining medically related business cards, appointment cards, and other medical contact information;

a document holder mounted on the front of said base for retaining prescriptions, medication instructions, therapy instructions, and other medically related documents;

a medication bin mounted on the front of a lowermost portion of said base, said bin being configured for retaining a plurality of medication containers, and for standing said apparatus on a flat horizontal surface;

an open slot formed in said base member for receiving a backing sheet of said questions pad, for removable mounting and replacement thereof on said base member; and a tab secured to the back of said base member below said open slot for retaining an end portion of the backing sheet of said questions pad.

27. Record keeping and logging apparatus for assisting a patient and/or medical provider and/or user in the control of compliance with specified medical regimens for one or a plurality of patients, or users, said apparatus comprising:

a base member configured from sheet material;

means for selectively either mounting said base member on a wall or an appliance, said base member having a front and a back;

a log pad mounted on the front of said base member for logging and tracking medication intake and/or health related regimens by at least one patient or user;

a questions pad mounted on the front of said base member for listing questions, information, and medical related experiences for professional consideration and/or answers;

at least one card holder mounted on the front of said base for retaining medically related business cards, appointment cards, and other medical contact information;

a document holder mounted on the front of said base for retaining prescriptions, medication instructions, therapy instructions, and other medically related documents;

a medication bin mounted on the front of a lowermost portion of said base, said bin being configured for retaining a plurality of medication containers, and for standing said apparatus on a flat horizontal surface;

a first open slot formed in said base member for receiving a backing sheet of said log pad, for removable mounting and replacement thereof on said base member;

a second open slot formed in said base member for receiving a backing sheet of said questions pad, for removable mounting and replacement thereof on said base member; and first and second tabs secured to the back of said base member below said first and second open slots, respectively, for retaining end portions of the backing sheets of said medicine log pad, and said questions pad, respectively.

* * * * *